United States Patent [19]

Opresko

[11] Patent Number: 4,554,479

[45] Date of Patent: Nov. 19, 1985

[54] CATHODE-RAY TUBE HAVING A LOW POWER CATHODE ASSEMBLY

[75] Inventor: Stephen T. Opresko, Manor Township, Lancaster County, Pa.

[73] Assignee: RCA Corporation, Princeton, N.J.

[21] Appl. No.: 559,378

[22] Filed: Dec. 8, 1983

[51] Int. Cl.[4] ..... H01J 31/02

[52] U.S. Cl. ..... 313/417; 313/446; 313/456

[58] Field of Search ..... 313/417, 446, 456, 270, 313/409

[56] References Cited

U.S. PATENT DOCUMENTS

| | | | |
|---|---|---|---|
| 2,416,315 | 2/1947 | Hartman | 250/27.5 |
| 3,259,783 | 7/1966 | Norris et al. | 313/337 |
| 3,569,768 | 3/1971 | Benda | 313/270 |
| 3,881,124 | 4/1975 | Buescher et al. | 313/47 |
| 3,883,767 | 5/1975 | Buescher et al. | 313/341 |
| 3,906,601 | 9/1975 | Buescher et al. | 445/36 |
| 3,914,638 | 10/1975 | Collins et al. | 313/270 |
| 3,919,751 | 11/1975 | Buescher et al. | 29/25.18 |
| 3,958,146 | 5/1976 | Buescher et al. | 313/346 R |
| 3,974,414 | 8/1976 | Buescher et al. | 313/331 |
| 4,071,803 | 1/1978 | Takanashi et al. | 313/409 |
| 4,370,588 | 1/1983 | Takahashi et al. | 313/37 |

*Primary Examiner*—David K. Moore

*Attorney, Agent, or Firm*—Eugene M. Whitacre; Dennis H. Irlbeck; Vincent J. Coughlin, Jr.

[57] ABSTRACT

A cathode-ray tube having an electron gun includes at least one cathode assembly comprising a novel cathode sleeve, a heater filament disposed within the sleeve and a cathode eyelet disposed around at least a portion of the cathode sleeve and attached thereto. The cathode sleeve has oppositely disposed ends, one end being open and the other end being closed by a cap having an electron emitting coating thereon. The novel cathode sleeve comprises a longitudinally extending first portion having a first diameter conforming closely to the heater body portion of the heater filament for reducing the power requirement thereof, and at least one other longitudinally extending portion having a diameter greater than the first diameter. The first portion and the other portion of the cathode sleeve being connected by a transition region inclined at an obtuse angle to the longitudinally extending first portion of the sleeve. A plurality of openings having a lateral dimension greater than the effective longitudinal dimension thereof are formed in the transition region to restrict the conduction of heat along the sleeve and to limit the radiative heat loss therethrough from the heater legs disposed within the sleeve.

11 Claims, 7 Drawing Figures

CATHODE-RAY TUBE HAVING A LOW POWER CATHODE ASSEMBLY

BACKGROUND OF THE INVENTION

The invention relates to cathode ray tubes and more particularly to a low power cathode assembly for such a tube in which thermal losses due to heat conduction along the cathode sleeve and radiation losses from the cathode sleeve are reduced.

U.S. Pat. No. 2,914,694, issued to T. N. Chin on Nov. 24, 1959, describes a low power cathode for an electron discharge device. A cathode sleeve is supported by a funnel-shaped member made of a material, such as a cobalt-nickel-iron alloy, having low heat conduction properties to minimize heat loss to the other cathode support structures. A cathode shield, also made of the same low heat conduction property material, surrounds and supports the funnel-shaped member. The funnel-shaped member and the cathode shield are provided with bright inner surfaces to reflect as much heat as possible back toward a cathode cap.

U.S. Pat. No. 4,370,588, issued to Takahashi et al. on Jan. 25, 1983, discloses a low power cathode having a cathode sleeve which is blackened to uniformly radiate heat. A first cylindrical reflective member surrounds the upper portion of the cathode sleeve and reflects heat from the cathode sleeve to reduce heat radiation to the outside. A second cylindrical reflective member supports the cathode sleeve on three support members. The inner surface of the second reflective member also reflects some of the heat from the lower portion of the cathode sleeve so that it is not radiated to the outside in order to provide a power savings. However, the openings between the support members permit some heat to be lost.

The aforementioned cathode structures each comprise a number of parts which require careful and costly assembly steps. Therefore, there is a need for a simple cathode structure that provides both low thermal conduction and low radiation losses.

SUMMARY OF THE INVENTION

A cathode-ray tube having an electron gun includes at least one cathode assembly comprising a novel cathode sleeve, a heater filament having a heater body portion with a pair of heater legs extending therefrom disposed within the sleeve, and a cathode eyelet disposed around at least a portion of the cathode sleeve and attached thereto. The cathode sleeve has oppositely disposed ends, one end beng open and the other end being closed by a cap having an electron emitting coating thereon. The novel cathode sleeve comprises a longitudinally extending first portion having a first diameter conforming closely to the heater body portion of the heater filament for reducing the power requirement thereof, and at least one other longitudinally extending portion having a diameter greater than the first diameter. The first portion and the other portion of the cathode sleeve being connected by a transition region inclined at an obtuse angle to the longitudinally extending first portion of the sleeve. A plurality of openings having a lateral dimension greater than the effective longitudinal dimension thereof are formed in the transition region to restrict the conduction of heat along the sleeve and to limit the radiative heat loss therethrough from the heater legs disposed within the sleeve.

DETAILED DESCRIPTION OF THE PREFERRED EMBODIMENTS

Figure 1:
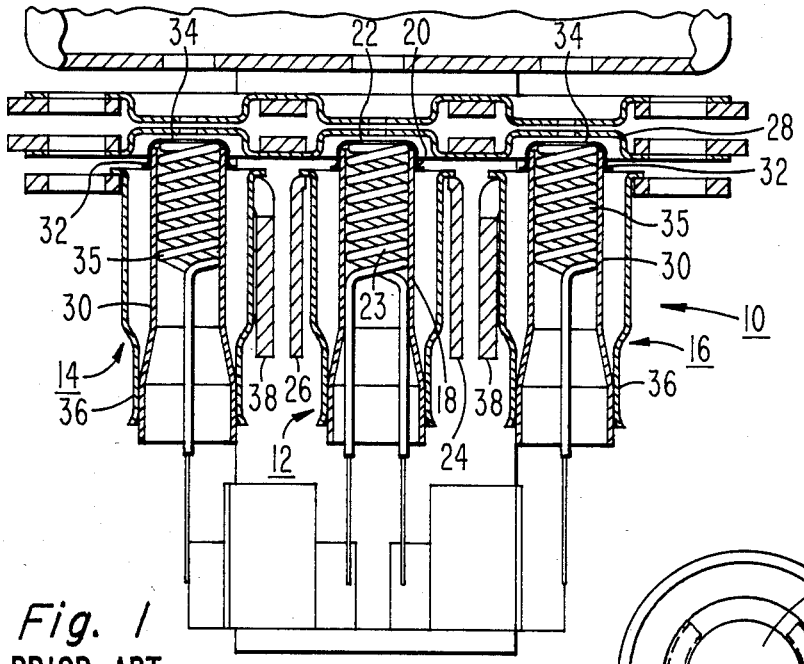
Fig. 1 PRIOR ART
FIG. 1 is a sectional view of a portion of a prior art inline electron gun assembly.

In FIG. 1, there is shown a portion of a prior art inline electron gun assembly 10 of a type used in color television cathode-ray tubes. The electron gun assembly 10 comprises a center cathode assembly 12, a first outer cathode assembly 14, and a second outer cathode assembly 16. The center cathode assembly 12 comprises a tubular cathode sleeve 18 closed at the forward end by a cap having an end coating 22 of an electron emitting material thereon. A heater filament 23 is mounted within the cathode sleeve 18. The electron emitting coating 22 is supported at a predetermined spacing from the aperture plane of a G1 grid 28 (also referred to as the control grid) by a center cathode eyelet 24 which is coaxially disposed around at least a portion of the cathode sleeve 18 and attached to the cathode sleeve 18 as well as to a fixed center cathode beading support member 26.

Similarly, the first and second outer cathode assembles 14 and 16, which are identical to the center cathode assembly 12, each comprise a tubular cathode sleeve 30 closed at the forward end by a cap 32 having an end coating 34 of an electron emitting material thereon. A heater filament 35 is mounted within each cathode sleeve 30. The electron emitting coatings 34 are each maintained at a predetermined spacing from the G1 grid 28 by a cathode eyelet 36 which is coaxially disposed around at least a portion of the cathode sleeve 30 and attached to the cathode sleeve 30 as well as to a fixed outer cathode beading support member 38. The predetermined spacings of the outer cathode assemblies are also established during fabrication and are substantially equal to the spacing of the center cathode assembly, which is approximately 0.13 mm.

Figure 2A:
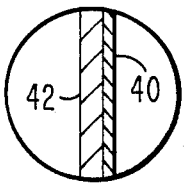
FIG. 2*a* is an enlarged sectional view of the portion of the cathode sleeve within circle 2*a* of FIG. 2.
Figure 2B:
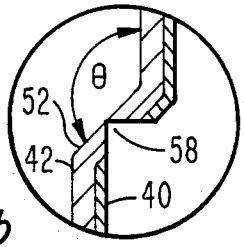
FIG. 2*b* is an enlarged sectional view of the transition region of the cathode sleeve within circle 2*b* of FIG. 2.
Figure 2:
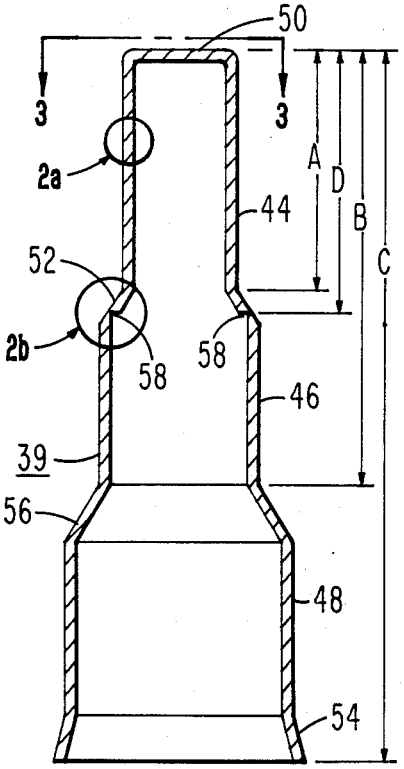
FIG. 2 is an enlarged sectional view of the novel cathode sleeve prior to the forming of the openings therein.

An improved novel tubular cathode sleeve 39 is formed by deep drawing, as shown in FIGS. 2, 2*a* and 2*b*. The cathode sleeve 39 is identical for each of the three cathode assemblies of the inline electron gun assembly 10. The cathode sleeve 39 comprises a laminated bimetal member including a first layer 40 and a second layer 42 shown in FIG. 2*a*. The first layer 40 preferably comprises Nichrome, which has a thermal conductivity of about 0.195 watts/cm/°K. at 700° K. Typically, the first layer 40 has a thickness of about 0.028 mm (1.1 mils). The second layer 42 preferably comprises bright nickel, which has a thermal conductivity of about 0.65 watts/cm/°K. at 700° K. and a thickness of about 0.048 mm (1.9 mils).

The cathode sleeve 39 includes three longitudinally extending portions 44, 46 and 48, respectively, of progressively larger diameters. The first portion 44 is closed at one end by an integral cap 50. The first portion 44 has an overall length, A, within the range of about 4.06 to about 4.83 mm and an outside diameter of about 1.47 to about 1.50 mm. The inside diameter of the first portion 44 is of the order of about 1.32 mm.

The second portion 46 terminates at a distance, B, from the top of the end cap 50. The distance B is within the range of about 5.84 to about 6.00 mm. The outside diameter of the second portion 46 is about 1.88 to about 1.91 mm. A first transition region 52, which is inclined at an obtuse angle $\theta$ of about 135 degrees with respect to the longitudinally extending first portion 44, connects the first and second portions 44 and 46, respectively, of the sleeve 39.

The third portion 48 terminates in a flare 54 surrounding the open end of the cathode sleeve 39 at a distance, C, from the top of the end cap 50. The distance C is about 8.76 mm. The outside diameter of the third portion 48 measured along the longitudinally extending wall ranges between about 2.59 mm to about 2.65 mm, and the flare 54 has a maximum outside diameter of about 2.90 mm. A second transition region 56, which is inclined at an obtuse angle of about 135° with respect to the second portion 46, connects the second and third portions 46 and 48, respectively, of the cathode sleeve 39.

Figure 3:
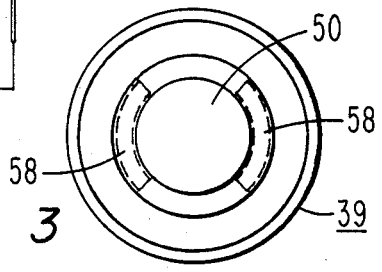
FIG. 3 is a top view of the novel cathode sleeve taken along lines 3—3 of FIG. 2.

In order to lower the thermal conductivity of the cathode sleeve 39 to concentrate the heat in the first portion 44 and, more particularly, in the end cap 50, the first layer 50 of the cathode sleeve 39 is pierced, as shown in FIGS. 2 and 2*b*, at a plurality of locations 58 in the first transition region 52. The locations 58 are spaced a longitudinal distance, D, ranging from about 4.23 to about 5.08 mm from the top of the end cap 50. While only two locations 58 are shown, three or more locations are within the scope of the invention. As shown in FIG. 3, the pierced locations 58 (shown in phantom) extend about 90° around the first transition region 52. When, for example, the first layer 40 is pierced at three locations, each of the pierced locations extend about 60° around the first transition region 52. The pierced locations 58 have a lateral dimension greater than the effective longitudinal dimension thereof. Subsequent to the piercing of the first layer 40, a portion of the nickel second layer 42 is selectively removed, for example, by etching in a suitable mixture of acetic and nitric acids. The etching exposes the first layer 40 from the bottom edge of the end cap 50 which extends about 1.27±0.25 mm along the first portion 44 to the flared end 54 of the cathode sleeve 39. The etching also removes the second layer 42 from the pierced locations 58 to form a plurality of arcuate openings 60, as shown in FIG. 4.

Figure 4:
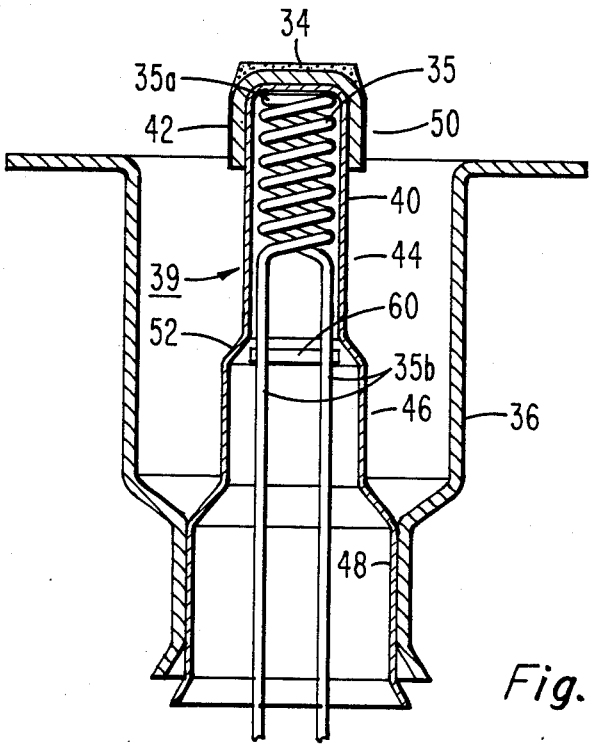
FIG. 4 is an enlarged sectional view of a cathode assembly including the novel cathode sleeve of the present invention.

The novel cathode sleeve 39 is shown in FIG. 4 to be disposed within the cathode eyelet 36. The eyelet 36 coaxially surrounds the cathode sleeve 39 and is attached thereto along the third portion 48 of the sleeve. The portion of the second layer 42 remaining on the first layer 40 and forming the end cap 50 has the electron emitting coating 34 deposited on the flat top surface thereof. The heater filament 35 has a heater body portion 35*a* and a pair of heater legs 35*b* extending therefrom. The heater body portion 35*a* is disposed within the first portion 44 of the sleeve 39. The first portion 44 of sleeve 39 conforms closely to the heater body portion 35*a* so that high efficiency thermal coupling is provided to quickly heat the electron emitting coating 34 to emission temperature. The longitudinal distance from the lower end of the heater body portion to the first transition region 52 is preferably at least twice as great as the diameter of the heater body portion 35*a* to minimize heat loss by radiation through the openings 60 (only one of which is shown) in the first transition region 52. The openings 60 act as a heat dam to prevent the conduction of heat along the body of the sleeve 39. The removal of the high thermal conductivity nickel second layer 42 from the Nichrome first layer 40 of the sleeve 39, except for that area forming the end cap 50, reduces heat conduction along the sleeve 39. Heat conduction along the sleeve 39 is further reduced by the presence of the openings 60 in the first transition region 52. The openings 60 formed in the inclined first transition region 52 are angled in such a manner as to have an effective length in the longitudinal direction less than their actual length along the inclined transition region. Thus, the openings 60 limit the radiative heat loss from the heater legs 35*b* by being inclined with respect to the heater legs, while providing effective resistance to heat conduction by interrupting the heat flow path from the end cap 50 of the first longitudinally extending portion 44 of the cathode sleeve 39.

Figure 5:
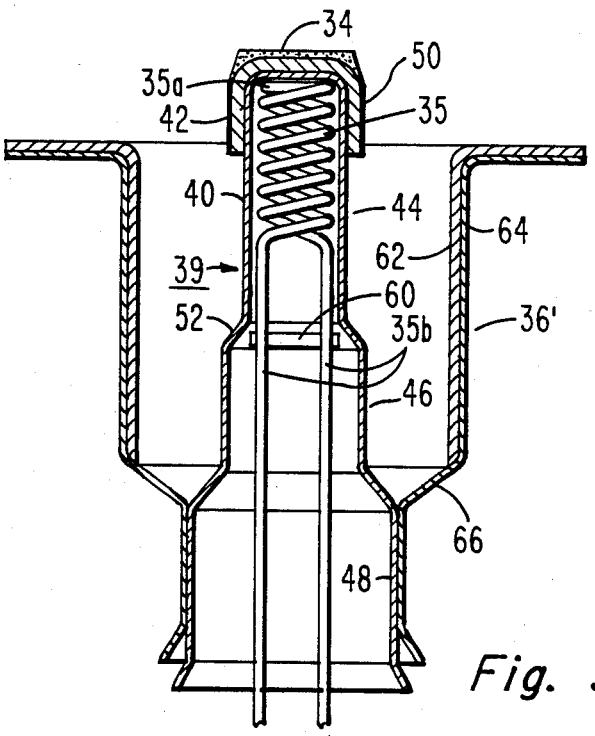
FIG. 5 is an enlarged sectional view of a second embodiment of a cathode assembly including the novel cathode sleeve of the present invention.

As shown in FIG. 5, an additional contribution to thermal conservation can be achieved by combining the above-described novel cathode sleeve 39 with the laminated bimetal cathode eyelet 36' described in my U.S. Pat. No. 4,514,660 issued on Apr. 30, 1985, which is incorporated by reference herein for disclosure purposes. The cathode eyelet 36' has a low emissivity interior nickel layer 62 overlying a portion of a low thermal conductivity Nichrome support layer 64. The interior nickel layer 62 terminates at a heat dam portion 66 of the Nichrome support layer 64. In the operation of the cathode assembly of FIG. 5, heat radiated outwardly by the cathode sleeve 39 is reflected by the nickel layer 62 back to the cathode 39 to maintain the temperature thereof. Heat conduction away from the end cap 50 is restricted by the low conductivity Nichrome layer 40, which comprises the body of sleeve portions 44, 46 and 48, and by the arcuately shaped openings 60 formed in the first transition region 52. The heat dam 66 in the eyelet 36' further retards heat conduction along the body of the eyelet.

What is claimed is:

1. In a cathode-ray tube having an electron gun including at least one cathode assembly comprising a cathode sleeve having oppositely disposed ends, said cathode sleeve being open at one end and closed at the other end, said closed end including a cap having an electron emitting coating thereon, a heater filament disposed within said sleeve, said heater filament having a heater body portion with a pair of heater legs extending therefrom, and a cathode eyelet disposed around at least a portion of said cathode sleeve and attached thereto, the improvement wherein said cathode sleeve comprises a longitudinally extending first portion having a first diameter conforming closely to said heater body portion of said heater filament for reducing the power requirement thereof, and at least one other longitudinally extending portion having a diameter greater than said first diameter, said first portion and said other portion being connected by a transition region inclined at an obtuse angle to said longitudinally extending first portion, and a plurality of openings in said transition region, said openings having an effective length in the longitudinal direction less than their actual length along the inclined transition region and a lateral dimension greater than the effective length thereof, said openings providing a heat dam to restrict the conduction of heat along the sleeve while limiting the radiative heat loss through said openings from said heater legs disposed within said cathode sleeve due to reduced effective length of said openings.

2. The tube as in claim 1, wherein said openings in said transition region are substantially arcuate in shape.

3. The tube as in claim 1, wherein said cathode sleeve comprises a laminated bimetal member having a first layer and a second layer, said second layer being contiguous with at least a portion of said first layer.

4. The tube as in claim 3, wherein said first layer comprises Nichrome and said second layer comprises nickel.

5. The tube as in claim 4, wherein said second layer comprising nickel is contiguous with only a part of said first portion of said cathode sleeve said part comprising said cap on said closed end of said cathode sleeve.

6. In a cathode-ray tube having an electron gun including at least one low power cathode assembly comprising a cathode sleeve having oppositely disposed ends, said cathode sleeve being open at one end and closed at the other end, said closed end including a cap having an electron emitting coating thereon, a heater filament disposed within said sleeve, said heater filament having a heater body portion with a pair of heater legs extending therefrom, and a cathode eyelet disposed around at least a portion of said cathode sleeve and attached thereto, the improvement wherein said cathode sleeve comprises a laminated bimetal member having a first layer and a second layer, said sleeve including at least three longitudinally extending portions of progressively larger diameters, the first portion having the smallest diameter which conforms closely to said heater body portion of said heater filament for reducing the power requirement thereof, said first portion being connected to the second portion by a first transition region inclined at an obtuse angle to said longitudinally extending first portion, said second portion being connected to the third portion by a second transition region, said third portion being attached to said eyelet, a plurality of openings formed in said first transition region, said openings having an effective length in the longitudinal direction less than their actual length along the inclined transition region and a lateral dimension greater than the effective length thereof to provide a heat dam to restrict the conduction of heat along the sleeve while limiting the radiative heat loss through said openings from said heater legs disposed within said sleeve due to the reduced effective length of said openings.

7. The tube as in claim 6, wherein said second layer is contiguous with said first layer on only a part of said first portion of said cathode sleeve, said part comprising said cap on said closed end of said sleeve.

8. The tube as in claim 6, wherein said heater body has a diameter less than the inside diameter of said first portion of said cathode sleeve.

9. The tube as in claim 8, wherein the longitudinal distance from the lower end of said heater body to the first transition region is at least twice as great as the diameter of said heater body, thereby minimizing heat loss by radiation through said plurality of openings in said first transition region.

10. A method of making a cathode sleeve for a low power cathode assembly wherein said sleeve comprises a laminated bimetal member having a first layer and a second layer, the method comprising the steps of:

forming a longitudinally extending first portion having a first diameter and being closed at one end, forming at least one other longitudinally extending portion having a diameter greater than said first diameter, said first portion and said other portion being connected by a transition region; and forming a plurality of openings in said transition region to restrict heat conduction along said cathode sleeve from said first portion.

11. The method of claim 10, wherein the step of forming a plurality of openings in said transition region includes the steps of piercing at least the first layer of said bimetal member at a plurality of location around said transition region, and selectively removing said second layer of said bimetal member from said other longitudinally extending portion, from said transition region and from a part of said longitudinally extending first portion to provide openings in said transition region and to form an end cap overlying at least said closed end of said first portion.

* * * * *